US006457762B1

(12) United States Patent
Garutti

(10) Patent No.: US 6,457,762 B1
(45) Date of Patent: Oct. 1, 2002

(54) SKI CARRYING DEVICE

(76) Inventor: Angelo Garutti, 1055 Shady La., Merritt Island, FL (US) 32952

( * ) Notice: Subject to any disclaimer, the term of this patent is extended or adjusted under 35 U.S.C. 154(b) by 32 days.

(21) Appl. No.: 09/712,566

(22) Filed: Nov. 14, 2000

(51) Int. Cl.[7] ..... A63C 11/02; E05B 73/00

(52) U.S. Cl. ..... 294/147; 294/141; 294/149; 70/18; 70/58; 224/257; 224/917; 280/814

(58) Field of Search ..... 294/141, 147, 294/149, 152, 165; 224/257, 258, 917; 24/306; 280/814, 809, 637; 70/18, 58

(56) References Cited

U.S. PATENT DOCUMENTS

| | | | | | |
|---|---|---|---|---|---|
| 1,405,052 | A | | 1/1922 | Maher | 294/74 |
| 2,118,875 | A | * | 5/1938 | Windheim | 224/609 |
| 2,508,795 | A | | 5/1950 | Nielsen | 224/53 |
| 3,590,608 | A | | 7/1971 | Smyth et al. | 70/58 |
| 3,714,803 | A | * | 2/1973 | Chenenko | 70/58 |
| 3,838,585 | A | * | 10/1974 | Foote | 70/18 |
| 3,947,927 | A | | 4/1976 | Rosenthan | 24/306 |
| 4,114,838 | A | | 9/1978 | Knauf | 224/45 S |
| 4,185,361 | A | * | 1/1980 | Stuart | 70/18 |
| 4,308,982 | A | | 1/1982 | Hall | 224/607 |
| 4,398,403 | A | * | 8/1983 | Menick | 70/18 |
| 4,630,842 | A | | 12/1986 | Roda | 280/814 |
| 4,673,118 | A | | 6/1987 | Kronz | 224/259 |
| 4,705,281 | A | * | 11/1987 | Spinas | 280/814 |
| 4,852,931 | A | * | 8/1989 | Ferdi | 280/814 |
| 4,867,478 | A | * | 9/1989 | Anderson | 280/814 |
| 4,903,875 | A | * | 2/1990 | Smart et al. | 224/258 |
| 4,911,347 | A | | 3/1990 | Wilhite | 224/257 |
| 5,174,481 | A | * | 12/1992 | LeDune | 224/257 |
| 5,190,336 | A | | 3/1993 | Palz | 294/147 |
| 5,318,209 | A | | 6/1994 | Rader et al. | 224/250 |
| 5,335,835 | A | | 8/1994 | Hogan | 224/257 |
| 5,383,587 | A | * | 1/1995 | Carpenter | 224/917 |
| 5,450,991 | A | | 9/1995 | Neading | 224/151 |
| 5,603,545 | A | * | 2/1997 | Benson et al. | 224/257 |
| 5,655,803 | A | | 8/1997 | Tacoronte | 294/1.1 |
| 5,979,726 | A | * | 11/1999 | Chisholm et al. | 224/917 |

FOREIGN PATENT DOCUMENTS

| | | | | |
|---|---|---|---|---|
| CH | 318337 | * | 2/1957 | 294/147 |
| DE | 2159394 | * | 12/1985 | 224/917 |
| GB | 2182238 A | | 5/1987 | |

* cited by examiner

*Primary Examiner*—Eileen D. Lillis
*Assistant Examiner*—Paul T. Chin
(74) *Attorney, Agent, or Firm*—Brian S. Steinberger; Law Offices of Brian S. Steinberger, P.A.

(57) ABSTRACT

A dual-purpose device that can be used to both carry a pair of skis and be used to lock skis. The device has a main line with looped ends, and a second line attached to a midsection of the main line having one exterior looped end. One of the looped ends of the main line is slipped over a pair of skis behind a foot support, and second line is wrapped about the skis and the other looped end of the main line is passed through the second line exterior loop, and can be draped over a shoulder of a user and held by a user's hand like a handle. Moving the handle raises and lowers the position of the skis. The skis are supported in a vertical position behind and separated from the user's back where the main line further acts as a cushion between the user's back and the skis. An adjustably positioned shoulder pad can be used to further cushion the main line from the user's shoulder. The device can be similarly used as a lock where instead of being draped over a shoulder the same looped end is wrapped about a ski rack, or pole and fastened to the second line's exterior looped end with a padlock.

13 Claims, 3 Drawing Sheets

SKI CARRYING DEVICE

This invention relates to skis, and in particular to a device for carrying a pair of skis safely and easily in a vertical position behind one's back.

BACKGROUND AND PRIOR ART

Carrying skis can be very awkward since a skier must hold the skis together using both hands. Additionally, such a method of carrying the skis can be dangerous since the skier may be walking over slippery ice surfaces and can fall and injure themselves. These problems can be further compounded, particularly in crowded areas.

Proposals have been made over the years for contraptions to make it easier to carry skis. However, many of these devices have the drawback of holding the skis in a horizontal direction, which is inherently clumsy. See for example, U.S. Pat. No. 3,947,927 to Rosenthal and U.S. Pat. No. 5,335,835 to Hogan each describe ski equipment carrying straps and ties that force the user to carry the skis in horizontal position which requires the user to use at least one and sometimes both hands.

Other proposals have been made over the years for allowing skis to be carried vertically behind one's back. U.S. Pat. No. 4,114,838 to Knauf, U.S. Pat. No. 4,903,875 to Smart et al.; U.S. Pat. No. 4,911,347 to Wilhite; U.S. Pat. No. 5,190,336 to Palz; U.S. Pat. No. 5,318,209 to Rader et al.; 5,450,991 to Neading; U.S. Pat. No. 5,655,803 to Tacoronte; and Great Britain patent 2,182,238 to Jordan each describe carriers for skis and poles having an elongated strap with ends that loop about opposite ends of a pair of skis where the elongated strap can be slung over a carrier's shoulders. However, these sling arrangements would be both awkward and uncomfortable since the skis would directly abut against and even bang up against the back of the user especially while the user is walking. Additionally, these slings would generally have a single height position when different sized skiers, and different sized skis are being used.

U.S. Pat. No. 4,308,982 to Hall requires a separate rigid backpack for being attached to the skis and poles. Besides, requiring the extra backpack, this device has further problem of needing a secure site to store the rigid backpack while the user is skiing. U.S. Pat. No. 4,673,118 to Kronz describes an elaborate crossed back strap apparatus for holding skis that would appear to be difficult to both put on and take off.

U.S. Pat. No. 4,630,842 to requires the pole tips to support the skis while the poles are held on the shoulder, which would clearly be a dangerous hazard to the skier carrying the skis since the poles stick out in front of the person carrying the skis.

Another problem with most of the above shoulder supported devices is that those devices continuously press into the shoulder(s) of the user further adding discomfort to the user.

Other patents of interest that fail to overcome the above problems include U.S. Pat. No. 3,590,608 to Smyth which describes a locking device which is used to fasten skis together in a locking position and generally requires their cable be fastened to some permanent unmoveable object, and does not describe any application for using the cable for carrying the skis. U.S. Pat. No. 1,405,052 to Maher describes a lumber sling for wrapping about a lumber type object and supporting the object by one end of a sling, and does not describe any application for carrying skis. Additionally, using Maher to carry skis would be at least as awkward and uncomfortable as the over the shoulder sling patents described above. The Maher device would carry longitudinal bundles in a horizontal position as shown by the lumber arrangement shown in FIG. 2, and trying to use the Maher sling over one's shoulder would cause the carried object to abut against and bang against one's back while the user is walking. U.S. Pat. No. 2,508,795 to Nielsen describes a mattress harness that does not describe any application for carrying skis, and would not overcome the deficiencies to the other prior art references described above.

SUMMARY OF THE INVENTION

The first objective of this invention is to provide a device for carrying skis behind one's back in a safe and easy vertical arrangement.

The second objective of this invention to provide a device for carrying skis behind one's back where the skis do not press against and bang up against the back of the user while the user is walking.

The third objective of this invention is to provide a device for carrying skis in a vertical position behind one's back where the skis hang away from the back of the user.

The fourth objective of this invention is to provide a device for carrying skis in a vertical position behind one's back where the weight of the skis is not completely supported by the shoulder of the user.

The fifth objective of this invention is to provide a device for carrying skis in a vertical direction behind one's back where the user can vary the height of the carried skis with one hand during transport.

The sixth objective of this invention is to provide a device for carrying skis in a vertical direction behind one's back where the user can vary the weight of the carried skis with one hand during transport.

The seventh objective of this invention is to provide a device for both carrying skis in a vertical direction behind one's back and also use the device to lock the skis together.

The eighth objective of this invention is to provide a simple and inexpensive device for carrying skis in a vertical position behind one's back that can be easily carried in one's pocket while not being used.

The ninth objective of this invention. is to provide a device for carrying skis in a vertical direction behind's one's back having an adjustable positioned pad for preventing any discomfort from the device pressing into the shoulder of the user.

A carrying device for holding and locking skis includes a main line with a first looped end and a second looped end opposite to the first looped end, a second line with a first end being fixably attached to a mid-section of the main line approximately midway between the first looped end and the second looped end, the second line having an exterior looped end opposite to the first end. The device is used with a pair of skis stacked bottom to bottom to one another, the skis having a rear end adjacent to foot bindings and an upper tip end opposite the rear end. In use the first looped end of the main line is slipped over the rear end of the pair of the skis to the foot bindings and the second line is wrapped about the pair of the skis above the foot bindings with the second looped end of the main line passing through the exterior looped end of the second line so that a portion of the main line adjacent to the second looped end can rest and be supported on a shoulder of a user and be held in place by a hand of the user holding the second looped end as a handle while the pair of the skis is supported in a vertical position behind and separated away from a back of the user, wherein the main line becomes a cushion between the skis the back of the user. The hand of the user can be moved up and down raising and lowering the vertical position of the stacked skis. An adjustably positioned shoulder pad can be used on the main line so that the device does not press into the shoulder of the user and instead adds to the comfort of the user.

The first and the second lines can be a cable, cord, a strap, and the like. The first loop, the second loop and the exterior loop can be attached to their respective lines by crimped sleeves such as crimped metal sleeves.

The device can be further used as a lock where the shoulder positioned looped end is wrapped about a ski rack, pole, and the like, and locked to the second line looped end with a padlock.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
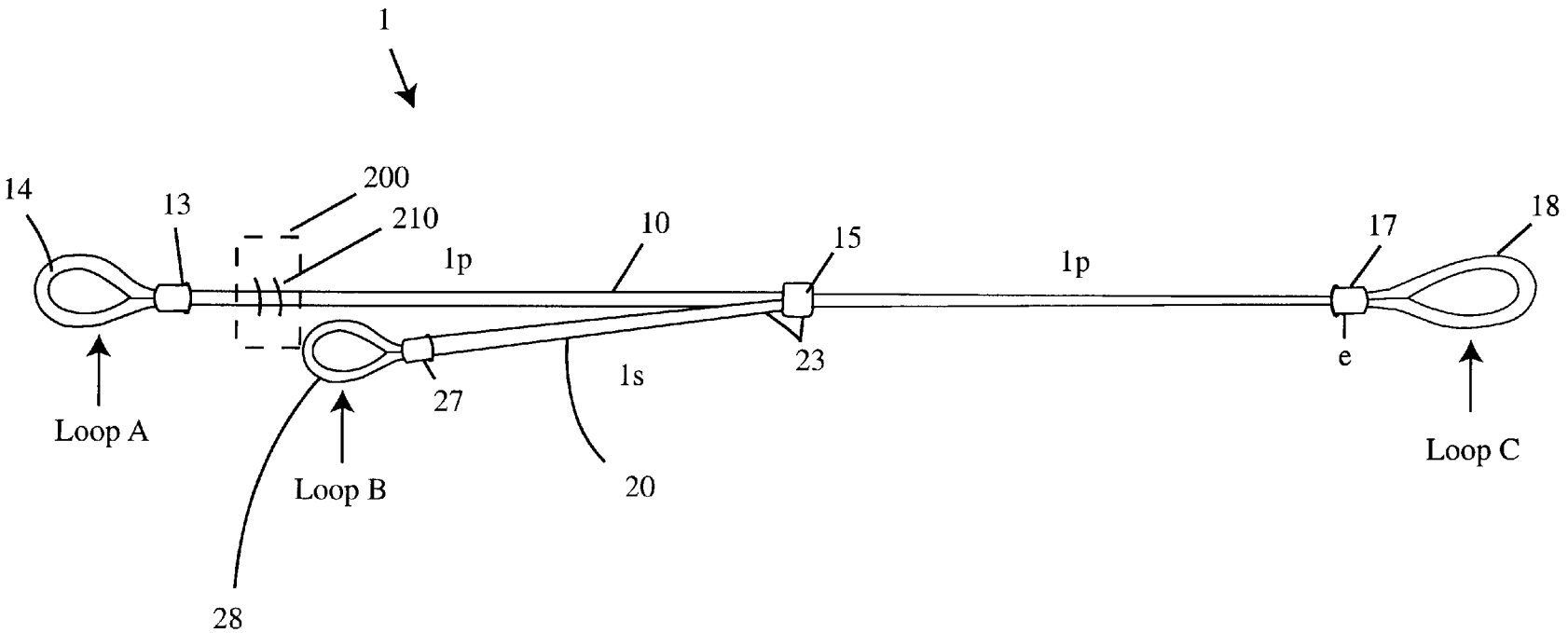
FIG. 1 is a side view of the novel ski carrying device with end loops about a main line and centrally attached second line having a loop end.

FIG. 1 is a side view of the novel ski carrying device 1 with end loops 14, 18 about main line 10 and centrally attached second line 20 having a loop end 28. Device 1 can have two lengths of cable 10 and 20 that can each be approximately ⅛ inch diameter stainless cable formed and held with metal sleeves firmly crimped at each connection. The primary length line 10 can be approximately 5 ft. long with a first loop 14 formed at one end of approximately 15 in. in circumference, and a second loop 18 formed at the other end of approximately 10 in. in circumference. The secondary length line 20 can be approximately 15 in. long, having one end joined to the primary length line 10 approximately mid way between loops 14 and 18, and the other end having a loop 28 formed therein of approximately 5 in. in circumference. The loop ends 14, 18, 28 can be made by taking an exposed end of the line and crimping the same in connections made with crimped metal sleeves 13, 17 and 27 respectively.

A shoulder pad 200 formed from flexible plastic, and the like, can be slidably attached to line 10 between points 13 and 15 by strap 210, so that the device 1 does not press into the shoulder of the user, and thus aids in the comfort of the device 1.

Figure 2:
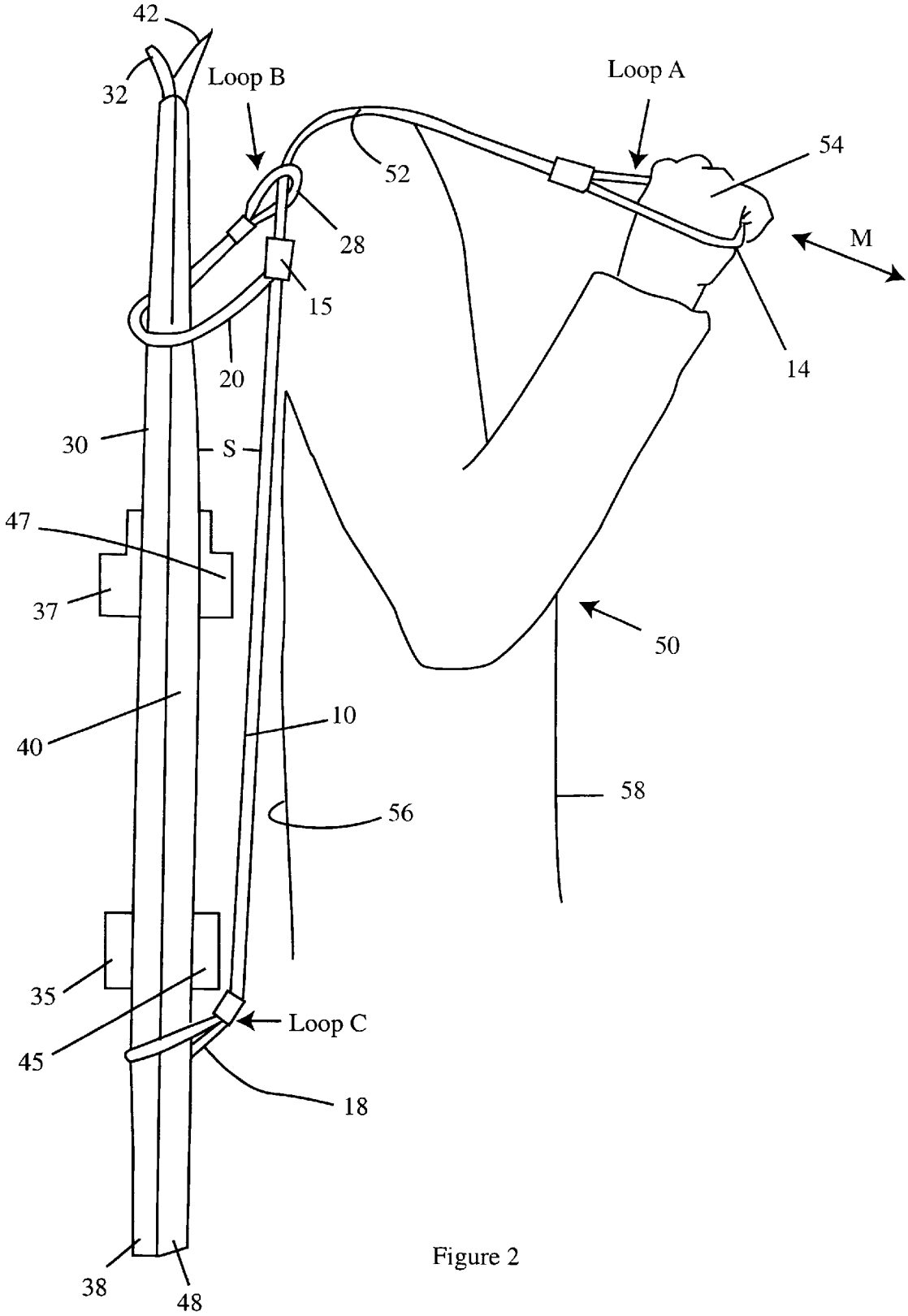
FIG. 2 shows a side view of the device of FIG. 1 holding a pair of skis over the shoulder of a user.

FIG. 2 shows a side view of the device 1 of FIG. 1 holding a pair of skis 30, 40 over the shoulder 52 of a user 50. A pair of skis 30, 40 can be positioned back to back to one another in a vertical position having their respective food bindings 35, 45 on exposed on opposite exterior sides. To use the device 1 as a carrier, loop 18 can be brought over the rear end 38, 48 of the skis and up to the rear bindings 35, 45. The main cable line 10 is oriented along the seam of the ski bottoms 38, 48 toward the tips 32, 42. Second cable line 20 is brought around in a wrap around fashion about the skis forward of the toe bindings 37, 47 so that loop 28 is in line with main cable line 10. Loop end 14(Loop (A)) is then brought through exterior loop end 28 (Loop (B)) and drawn through until loop (B) is adjacent. to the crimped sleeve 15 joining main cable line 10 to second cable line 20. Taking loop end 14(Loop (A)) in hand 54, the user 50 can bring an upper portion of the main cable line 10 over a shoulder 52 lifting the skis 30, 40 to hang behind and separated by a space S, and by main line 10 from the user's back 56 back to be safely and easily carried wherever headroom allows. Clearly, the skis 30, 40 will not abut against and/or bang up against the back 56 of the user. In use, the main line 10 between the shoulder 52 and loop end 18 becomes a pliable cushion between the skis 30, 40 and the user's back 56. Moving the user's hand 54 forward and backward in the direction of double arrow M, causes the skis 30, 40 to be easily raised and lowered as needed for tall and short users and/or long and short skis.

Figure 3:
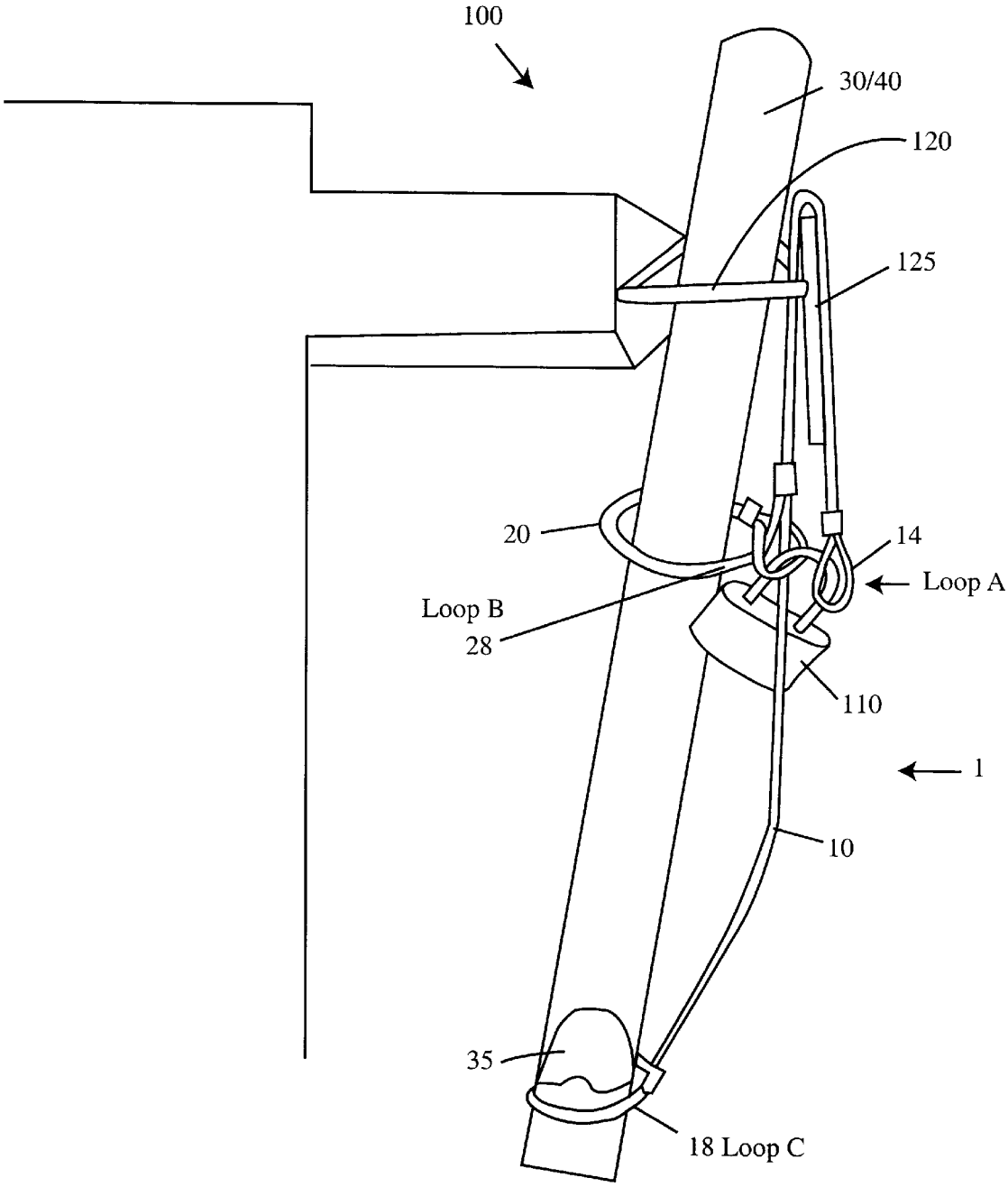
FIG. 3 shows another view of the device of FIG. 1 being used as a lock.

FIG. 3 shows another view of the device 1 of FIG. 1 being used in a locking arrangement. When skis 30, 40 are left unattended, loop (A) of device 1 can be brought around any fixed object such as a wall connected rack 120, 125 and joined to loop (B) with a padlock 110, preventing loss. Similarly, loop 14 can be wrapped about vertical and horizontal poles and the like, in a similar locking arrangement.

When not being used the device 1 can easily be coiled to fit into a bundle that is carried in one's pocket.

Although the invention describes lines 10, 20 of device 1 as being cables, the invention can be used with other lines such as rope, cords, and the like, and as well as straps, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A carrying device for holding on shoulders of skiers while keeping the skis away from the skiers' backs, comprising in combination:

a main line having a first fixed looped end and a second fixed looped end opposite to the first looped end;

a second line having a first end being fixably attached to a mid-section of the main line approximately midway between the first looped end and the second looped end, the second line having an exterior looped end opposite to the first end; and a pair of skis stacked side by side to one another, the skis having a rear end adjacent to foot bindings and an upper tip end opposite the rear end, wherein the second looped end of the main line is slipped over the rear end of the pair of the skis behind the foot bindings and the second line is wrapped about the pair of the skis above the foot bindings with the first looped end of the main line passing through the exterior looped end of the second line so that a carrier-user using the carrying device allows for a portion of the main line adjacent to the first looped end to rest on and be supported by a shoulder of the carrier-user, and the device is held in place by a hand of the carrier-user holding the first looped end as a handle while the pair of the skis is supported in a vertical position behind and separated away from a back of the carrier-user, wherein the main line forms a cushion between the skis and the back of the carrier-user.

2. The carrying device of claim 1, wherein at least one of the main line and the second line includes a strap.

3. The carrying device of claim 1, wherein at least one of the main line and the second line includes a cable.

4. The carrying device of claim 3, wherein at least one of the first loop, the second loop and the exterior loop includes a crimped sleeve.

5. The carrying device of claim 4, wherein each of the first loop, the second loop and the exterior loop includes a crimped sleeve.

6. The carrying device of claim 1, further comprising:

a pad for being slidably attached to the main line for cushioning the portion of the main line from pressing against the shoulder of the user.

7. A method of carrying skis in vertical positions on shoulders of and behind backs of carrier users with a carrying device, comprising the steps of:

stacking a pair of skis bottom to bottom to one another, the skis having a rear end adjacent to foot bindings and a tip end opposite to the rear end;

inserting the rear end of the pair of the skis through a bottom looped end on a main line below the foot bindings;

wrapping a second line about the pair of the skis above the foot bindings, the second line having one end attached to a mid portion of the main line, the second line having an exterior looped end;

passing an upper looped end of the main line through the exterior looped end of the second line;

resting a portion of the main line adjacent to the upper looped end on a shoulder of a carrier-user with the pair of the skis being held in a vertical position behind a back of the carrier-user; and separating the back of the carrier-user from the vertically positioned skis by the main line with a space between the back of the carrier-user and the skis.

8. The method of carrying skis of claim 7, further including the steps of:

supporting the device by a hand of the carrier-user holding the upper looped end of the main line as a handle; and varying the vertical position of the device by moving the hand of the carrier-user up and down.

9. A carrying device for locking skis in vertical positions to racks, comprising in combination:

a main line having a first looped end and a second looped end opposite to the first looped end;

a second line having a first end being fixably attached to a mid-section of the main line approximately midway between the first looped end and the second looped end, the second line having an exterior looped end opposite to the first end;

a pair of skis stacked bottom to bottom to one another, the skis having a rear end adjacent to foot bindings and an upper tip end opposite the rear end;

a rack having an opening for storing skis in vertical positions, wherein the second looped end of the main line is slipped over the rear end of the pair of the skis behind the foot bindings and the second line is wrapped about the pair of the skis above the foot bindings with the first looped end of the main line passing through the exterior looped end of the second line, and the first looped end is passed through the rack; and a lock for lockably attaching the first looped to the exterior looped end, so that the skis are stored and locked in a vertical position to the rack.

10. The carrying device of claim 9, wherein the lock includes a padlock for locking the skis to the rack.

11. The carrying device of claim 9, wherein at least one of the main line and the second line includes a strap.

12. The carrying device of claim 9, wherein at least one of the main line and the second line includes a cable.

13. The carrying device of claim 12, wherein at least one of the first loop, the second loop and the exterior loop includes a crimped sleeve.

* * * * *